US005934716A

United States Patent [19]

Koveal et al.

[11] Patent Number: 5,934,716

[45] Date of Patent: Aug. 10, 1999

[54] SLAM LATCH AND METHOD OF ASSEMBLY

[75] Inventors: Stefan M. Koveal, Glen Mills; Leo R. Knapp, III, Springfield, both of Pa.

[73] Assignee: Southco, Inc., Concordville, Pa.

[21] Appl. No.: 09/031,587

[22] Filed: Feb. 27, 1998

[51] Int. Cl.[6] ..... E05C 1/10

[52] U.S. Cl. ..... 292/175; 292/DIG. 38; 292/DIG. 61; 292/DIG. 63

[58] Field of Search ..... 292/171, DIG. 38, 292/DIG. 61, DIG. 63, 170, 175, DIG. 31, DIG. 53; 70/208, 210, 144, 145

[56] References Cited

U.S. PATENT DOCUMENTS

| | | | |
|---|---|---|---|
| 3,841,674 | 10/1974 | Bisbing et al. | 292/175 |
| 3,850,464 | 11/1974 | Bisbing et al. | 292/175 |
| 4,790,579 | 12/1988 | Maxwell et al. | 292/175 |
| 5,263,750 | 11/1993 | Smith et al. | 292/336.3 |
| 5,440,905 | 8/1995 | Yamada | 70/208 |
| 5,664,813 | 9/1997 | Gromotka | 292/229 |

OTHER PUBLICATIONS

Pp. G–6 and G–7 from Southco catalog 43, 1993.
Pp. G–8 and G–9 from Southco catalog 48, 1998.

*Primary Examiner*—Darnell M. Boucher
*Assistant Examiner*—John B. Walsh
*Attorney, Agent, or Firm*—Paul & Paul

[57] ABSTRACT

A sliding-action slam latch for securing a door panel, especially a hinged door panel, in closed position with a latch body constructed of one piece and carrying a spring which is installed therein; the latch being installed in a single opening in the door panel and is self-retained therein. The latch operates by spring-biased sliding action to engage the door frame or striker place. The spring bias is provided by a separate spring member and the latch is further provided with a spring guide to facilitate installation of the spring into the latch. A method of assembly of the latch is also provided.

19 Claims, 7 Drawing Sheets

SLAM LATCH AND METHOD OF ASSEMBLY

BACKGROUND OF THE INVENTION

1. Field of the Invention

This invention relates to latches used to secure, in closed position, hinged panels on doors.

The invention relates especially to that class of latches in which a camming surface on the end of a sliding-bolt element cooperates with a striker surface on the door frame to cause the bolt action to secure the door upon its closing against the frame.

2. Brief Description of the Prior Art

The slam action principle has been widely used in the prior art and has been embodied in various latch designs which usually incorporate a housing which encloses several components, one of which is a sliding-bolt element. The general characteristic of this type of latch is that it is activated to secure the door by cooperation of a door-frame-mounted striker when the door is merely pushed shut or slammed, but some operation of the latch mechanism is required to release the latch and open the door.

The particular class of latches to which the present invention belongs uses a cam surface on the end of the bolt element to cooperate with the striker surface to slide the bolt into the housing against the force of a spring contained therein. This spring force thereafter urges the bolt to engage behind the door frame or to engage a keeper element provided on the door frame. In order to open a door secured with such a latch, a hand grip is usually provided to operate the mechanism which withdraws the end of the bolt from engagement with the keeper on the door frame.

Presently available latches of the sliding-bolt slam type are installed by mounting the latch assembly to the door panel using rivets, or bolts and nuts, or screws, or other fastening means.

Other slam latches include a flexible wall portion or a spring to bias sliding action of the latch for opening and closing. Examples are shown in U.S. Pat. No. 3,841,674 and 3,850,464, both entitled "Slam-Latch", the complete disclosures of which are herein incorporated by reference. These type of latches operate by a spring-biased sliding action to engage a door frame or striker plate. A separate spring member has been employed in this type of latch. However, in the operation of the latch, the spring member has been known to be impeded by catching on an adjacent wall of the latch. The present invention attempts to resolve the problem associated with prior art latches of this type by providing a novel improved slam-latch.

SUMMARY OF THE INVENTION

The primary object of the present invention is to provide a latch of the sliding-bolt slam-action type which may be more easily installed, at low cost, without the use of rivets, or bolts and nuts, or screws, or other fasteners, and with improved operation.

The foregoing object is accomplished in accordance with an embodiment of the present invention, by constructing a latch of material having sufficient resilience or spring characteristics to achieve "snap-in" installation wherein the slam-latching function is provided by a separate spring, and wherein the spring is featured to provide cooperative operation with the panel on which the latch is installed or with which the latch is associated.

Another object of the present invention is to provide a novel method for assembling a latch wherein a separately provided spring member is installed into the latch.

DETAILED DESCRIPTION OF THE PREFERRED EMBODIMENTS

Figure 1:
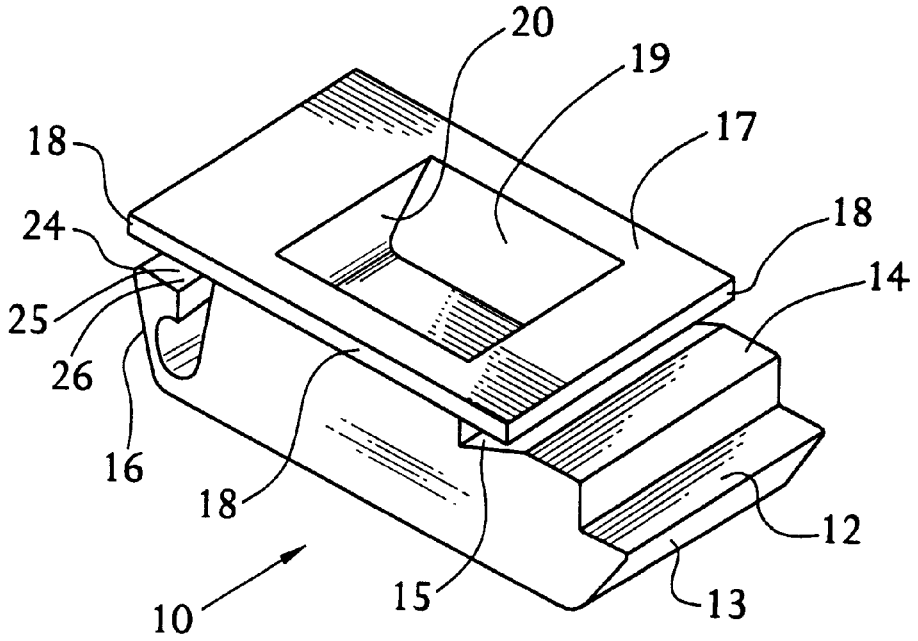
FIG. 1 is a perspective representation of an embodiment of the latch of the present invention.

Referring now to FIG. 1, this figure is a perspective view of one embodiment of the invention wherein the slam latch comprises a single component of a resilient plastic material formed by molding or by other manufacturing methods. The slam latch of FIG. 1 includes a latch body 10 having at one end a frame-engaging portion 12 adapted to engage the frame F, an angled camming surface 13, an adjacent guide surface 14, and a shaped recess 15. Latch body 10, at its other end, has an upstanding wall portion 16 which is integral with the body 10 of the latch at its base but which is spaced therefrom there above. The wall portion 16 flexes to allow insertion of the latch body 10 into the panel opening after which the wall portion 16 snaps back into a position to retain the latch in the panel. A metallic spring element is provided shown comprising a torsion coil spring 29. The spring 29 has a first spring arm 30 with a hook portion 31 extending therefrom. The spring arm end opposite the hook end joins a coil portion 33 of the spring. A second spring arm 32 is provided and engages the latch body transverse wall 35. The spring bias for the sliding movement of the latch is provided only by the metallic spring element 29. A top surface 17 covers the latch body 10 and projects therebeyond in all directions forming a peripheral flange 18. The peripheral flange 18 overlaps the perimeter of the installation hole provided in the door or other panel.

A finger cavity 19 is provided in the top surface 17 having a rearward wall 20 which inclines rearwardly downwardly.

Figure 4:
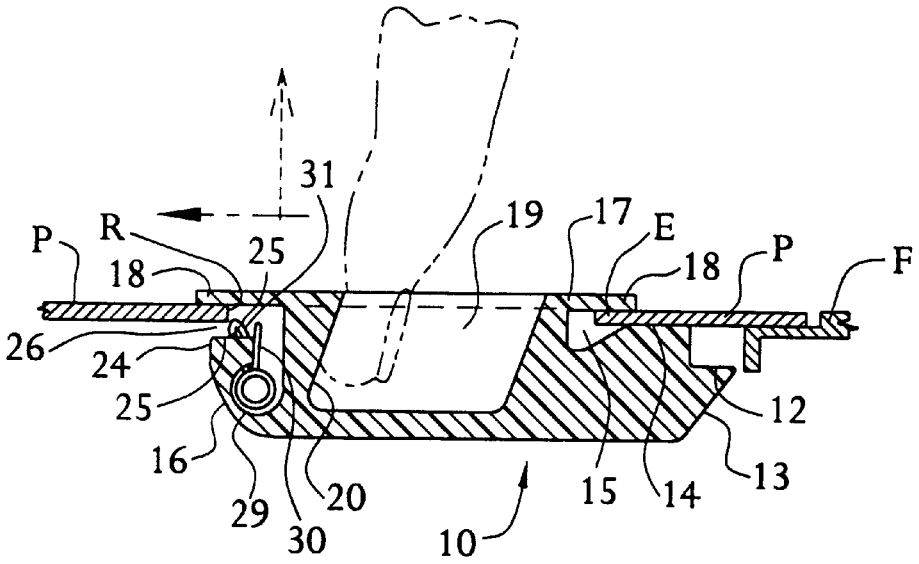
FIG. 4 illustrates a longitudinal sectional view of the latch of FIG. 3 being pushed to its rearward or unlatched position.

By means of finger cavity 19, the latch may be manually slid rearwardly to its unlatched position, as indicated in FIG. 4, whereupon the door may be pulled open by the finger, shown in phantom in FIG. 4, as indicated by the phantom arrows.

Figure 2:
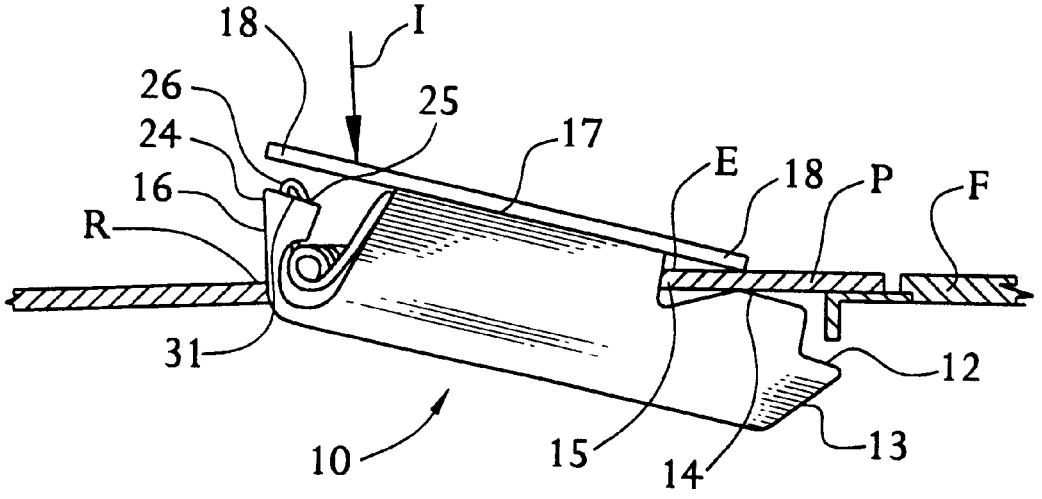
FIG. 2 is a left side elevation view of the latch of FIG. 1 shown in an interim position during its installation into a door panel.

FIG. 2 illustrates the manner in which the latch body of FIG. 1 is inserted into a rectangular opening prepared in the door panel P. The recess 15 has a specific shape and size for receiving the forward edge E of the opening in the door panel P. During installation, the rear edge R of the opening contacts the wall portion 16, which flexes to permit insertion of the latch into the rectangular opening on the door panel P. From the partial insertion position illustrated in FIG. 2, the latch body 10 is rotated counter-clockwise about the forward edge E of the panel opening. During this rotation, the wall portion 16 is forced to bend forwardly, toward the latch body 10, to allow the upper edge 24 of the wall portion 16 to pass by the rear edge R of the panel opening. In this manner, the latch is inserted into the panel opening into its final position, illustrated in FIG. 3. In FIG. 2, the installation force is indicated by the arrow "I".

Figure 3:
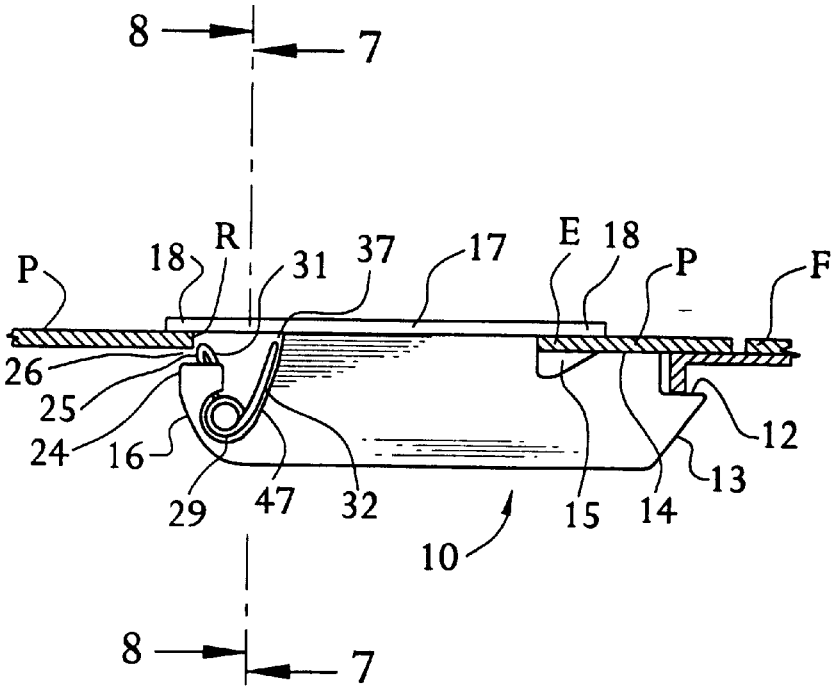
FIG. 3 is a left side elevation view of the latch embodiment of FIGS. 1 and 2 shown fully installed in a door panel. The latch unit in FIG. 3 is shown in its forward or latched position.

Referring now to FIG. 3, the latch is here shown in its normal latched position. All edges of the panel opening underlie and are concealed by the peripheral flange 18 of the top 17. The upper end of wall portion 16 is shown comprising a ledge 25 which is spaced apart from said peripheral flange 18 of the top 17 to define a space 26 therein for accommodating the rear edge R of the panel opening between the undersurface of the flange 18 and ledge 25, which in said space 26 the rear edge R is slidingly maintained. The panel portion adjacent the front edge E of the opening is slidingly maintained between the undersurface of the flange 18 and the guide surface 14. The frame-engaging portion 12 retains the latch body 10, and hence the door panel P, in a closed position with respect to frame F.

In FIG. 4, by means of the finger shown in phantom, the latch has been pushed slidingly to its rearward position against the action of the torsion spring 29. This is the unlatched position of the latch, with the frame-engaging portion 12 being withdrawn to clear the door frame F. The front edge E of the panel opening has moved forwardly in the cavity 15 but nevertheless remains captive beneath the flange 18, as is clearly seen in FIG. 4. The rear edge R of the panel opening continues to be retained in the space 26 formed by the ledge 25 of wall portion 16 and the flange 18.

During operation of the latch, the first spring arm 30 is forced toward the body 10 of the latch (from its FIG. 3 position to its FIG. 4 position) by the rear edge R of the opening of the panel P which engages the hook portion 31 of the first spring arm 30. With the latch 10 slid to the left, as shown in its FIG. 4 position, the spring 29 has been compressed, and there exists a bias of the latch frame-engaging portion 12 toward engagement with the frame F. When the rearwardly applied force supplied by the finger in cavity 19 is removed, or, for that matter, when the latch body is free from that or any other outside force, the first spring arm 30 and hook 31, return from the FIG. 4 position to the position shown in FIG. 3, and this force urges the latch body 10 to slide forwardly with respect to the panel P until the forward edge of the panel opening abuts against the rearward edge of cavity 15, as illustrated in FIG. 3. Thus, the spring 29 by returning to its closed or rest position, causes the frame-engaging portion 12 of the latch body 10 to engage the door frame F.

Figure 8:
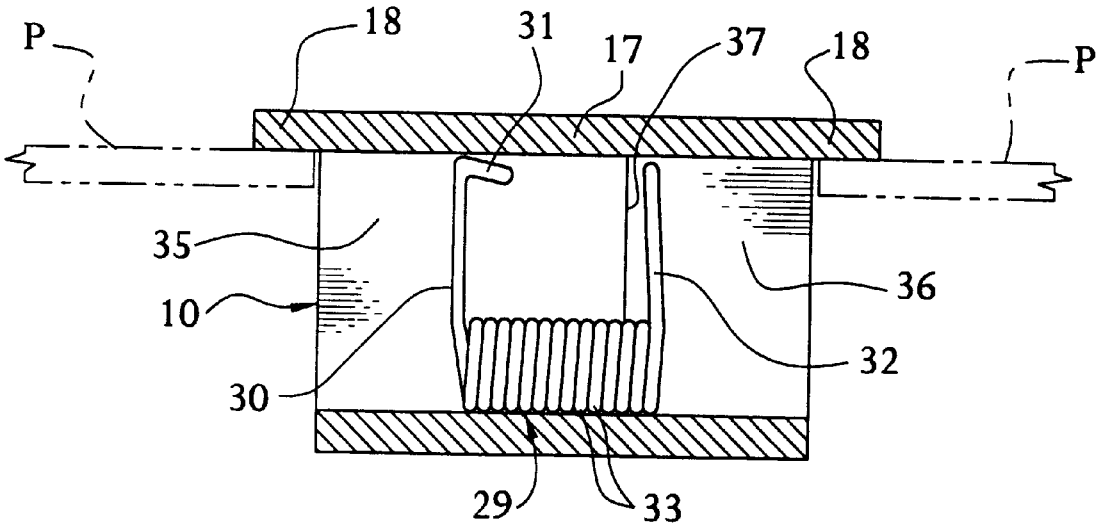
FIG. 8 is a sectional view of the latch taken along the line 8—8 of FIG. 3.

As shown in FIGS. 3 and 8, the transverse wall 35 preferably comprises a vertically disposed partially inclined wall section 36, which is defined in part by a corner wall segment 37. The corner wall segment 37 appears having a triangular configuration, with the vertex 47 pointing downward in relation to the peripheral flange 18 of the latch which the base portion or top of the corner wall segment 37 joins. The upstanding wall portion 16 opposes the transverse wall 35 of the latch body 10.

Containing means is provided to facilitate the holding of the spring member 29 within the assembly. The panel P moves forward within the space 26, and the rearward panel edge R moves the spring arm 30 toward the latch body 10. The spring containing means preferably is provided in the form of an extending portion which extends in part over the spring member 29. The spring containing means is shown extending from the upstanding wall portion 16 of the latch and having an arcuate configuration 27 which partially surrounds the spring coil 33.

Figure 6:
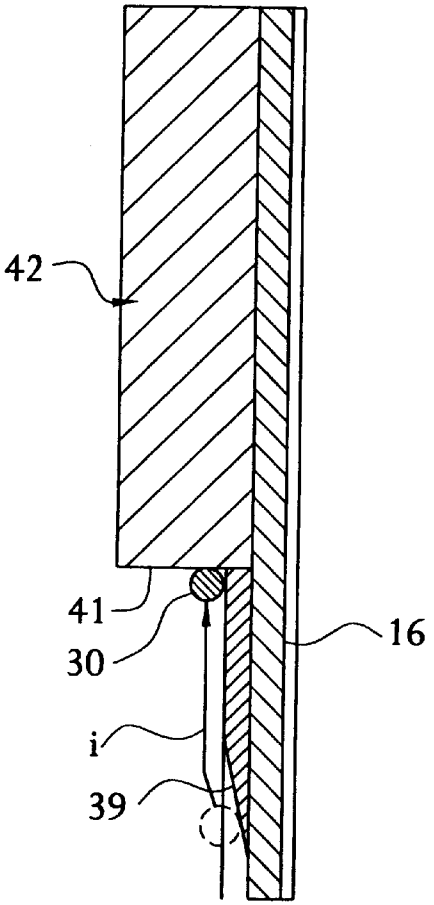
FIG. 6 is a sectional view of the rib of the latch taken along the line 6—6 of FIG. 5.
Figure 5:
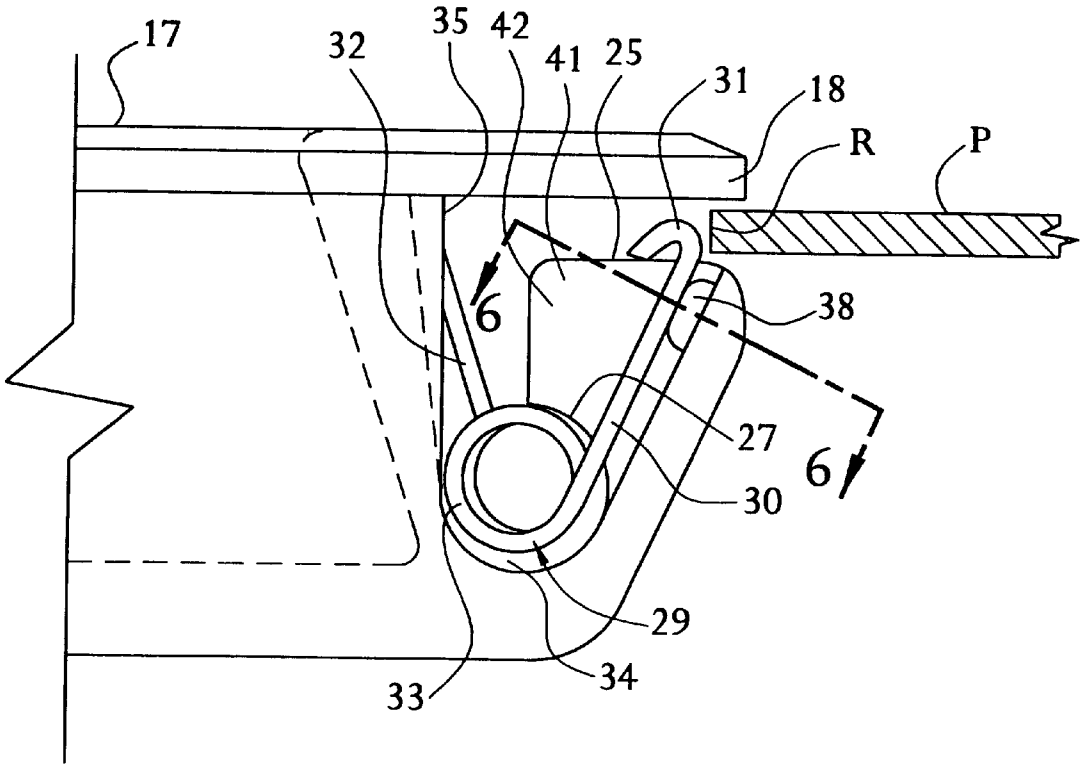
FIG. 5 is a right side elevation view of the rear portion of the latch of FIG. 3.

FIGS. 5 and 6 illustrate the spring installment means of the present invention. The upstanding wall portion 16 with the transverse wall portion 35 of the latch body 10 define a holding space 34 therein where the spring member 29 is disposed. Preferably, the spring member 29 is installed by sliding it into the space 34 in a direction parallel to its installed position. Spring installment means is provided for facilitating the installation of the spring member 29 into the latch. The spring installment means is shown comprising deflection means including the protruding rib member 38 which extends outwardly from the upstanding wall portion 16 toward the rear transverse wall 35 of the latch body 10. Preferably, the rib member 38 has a beveled or sloped side 39 (see FIG. 6) to provide wedging leverage of the first spring arm 30 in a direction away from the upstanding wall 16, when the spring 29 is inserted for installation into the receiving space 34. The leveraging of the spring 29 compresses the first spring arm 30 against the force of the spring coil 33 to provide a raising of the first spring arm 30 and hook 31 attached thereto in a vertical direction. The spring 29 is inserted from the right side (the side shown in FIG. 5) of the latch by sliding into the space 34, with the second or rearward spring arm 32 being inserted first into the right side of the latch. When the first spring arm 30 is slid into the space 34, the arm 30 eventually engages the rib 38 whereupon the spring 29 is further inserted to complete its installation into the latch. During this further part of the insertion, the first spring arm 30 is directed with the rib 38 and travels along the rib 38 until it reaches the sidewall 41 of the protruding portion 42. This is represented by the spring movement in FIG. 6 which, during installation, moves from its phantom-line position to its final, installed position, in the direction of arrow "i".

Figure 7:
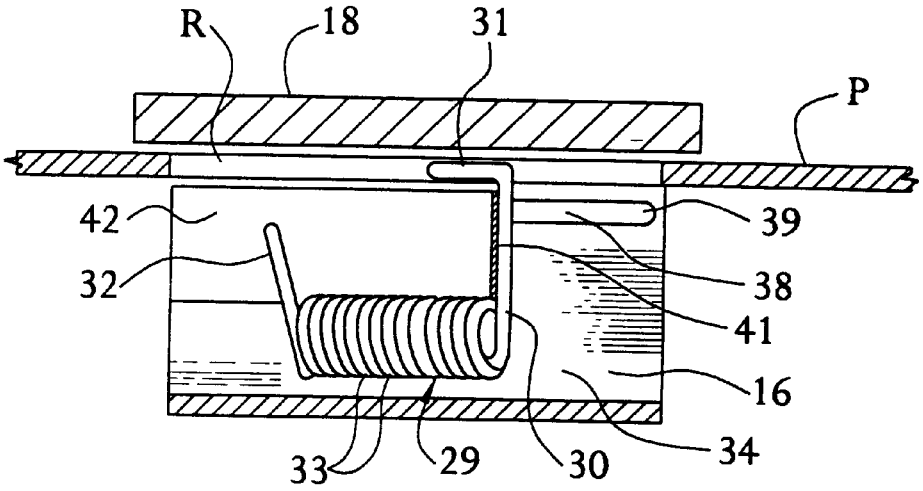
FIG. 7 is a sectional view of the latch taken along the line 7—7 of FIG. 3.

FIG. 7 shows a sectional view of the latch body 10 with the spring member 29 installed, as if viewed from the transverse wall 35 of the latch body 10 looking toward the rear of the latch. The rib member 38 is shown extending transversely from one side of the upstanding wall portion 16 toward the center of the latch and terminating at sidewall 41. FIG. 8 shows the opposing view with respect to FIG. 7, which shows the transverse wall portion 35 of the latch body.

Figure 9:
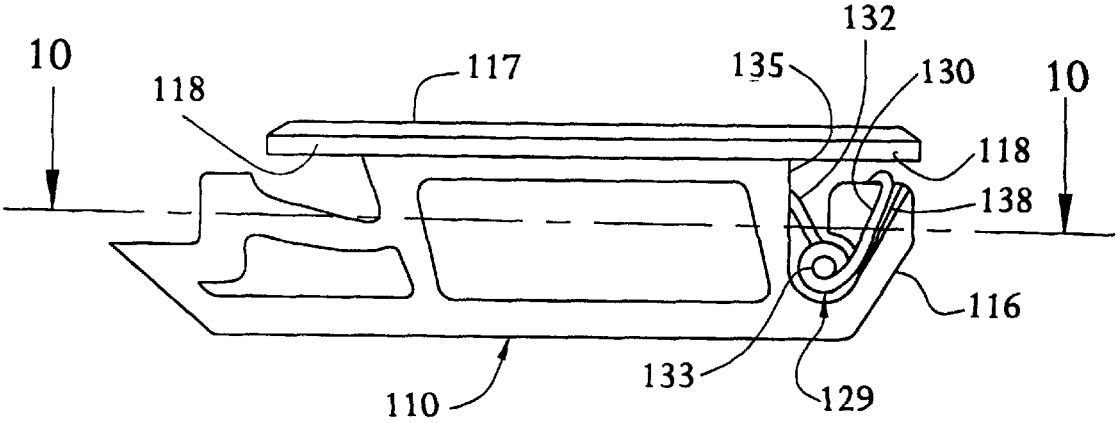
FIG. 9 is a right side elevation view of an alternate embodiment of a latch according to the present invention.
Figure 10:
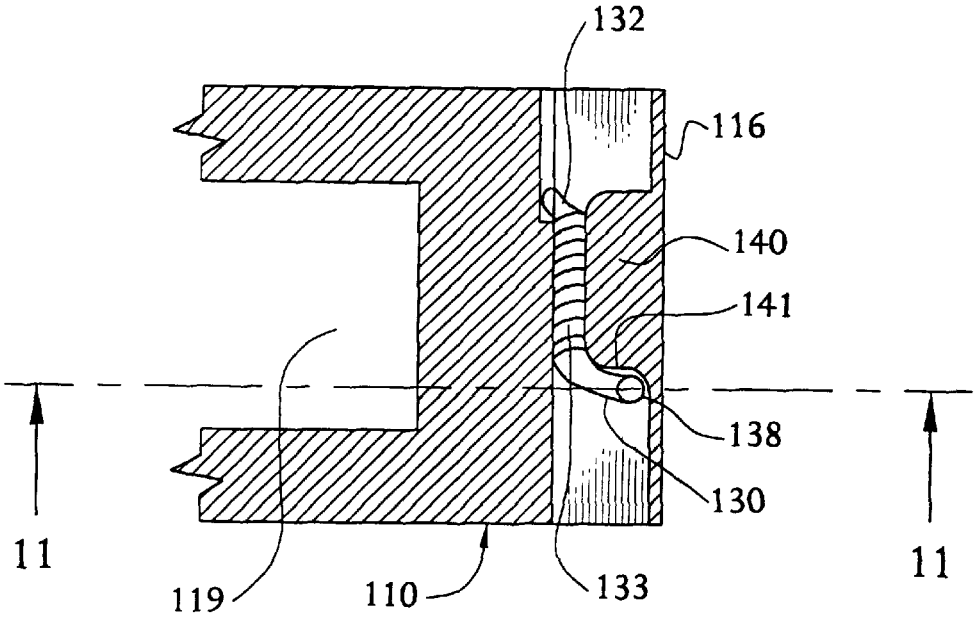
FIG. 10 is a top sectional view of the latch of FIG. 9 taken along the line 10—10 of FIG. 9 showing the rear portion of the latch.
Figure 11:
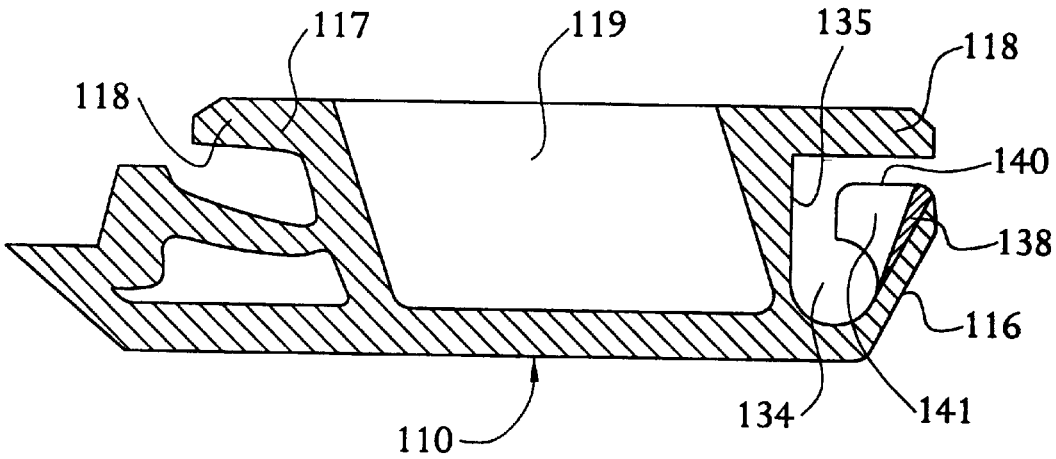
FIG. 11 is a longitudinal sectional view of the body of the latch shown in FIGS. 9 and 10 taken along the line 11—11 of FIG. 10.

An alternate embodiment of a latch 110 according to the present invention is shown in FIGS. 9–11. The latch 110 is provided similar to the latch 10 described above, with the above features, but has a different configuration with respect to its rearward section. The spring installment means is provided comprising an inclined wall portion 138 which extends vertically along the interior portion of the upstanding wall portion 116. The spring 129 in FIG. 9 is shown installed in the latch 110 in the space 134 formed between the transverse wall 135 of the latch body 110 and the interior of the upstanding wall portion 116.

The first spring arm 130 is positioned closer to the transverse wall portion 135 by the inclined wall portion 138. The inclined wall portion 138 is engaged by the first spring arm 130 when the spring 129 is inserted into the latch body 110. As shown in FIG. 10, the inclined wall portion has a cross-sectional thickness which increases from the right side of the latch to the wall 141 of the protrusion 140. The protrusion 140 extends from the upstanding wall 116 to partially surround the spring coils 133. The inclined wall portion 138 preferably, in addition to being inclined through its lateral, cross-sectional dimension, as shown in FIG. 10, has a vertical or longitudinal inclination, as seen in the cross-sectional view of FIG. 11.

Figure 12:
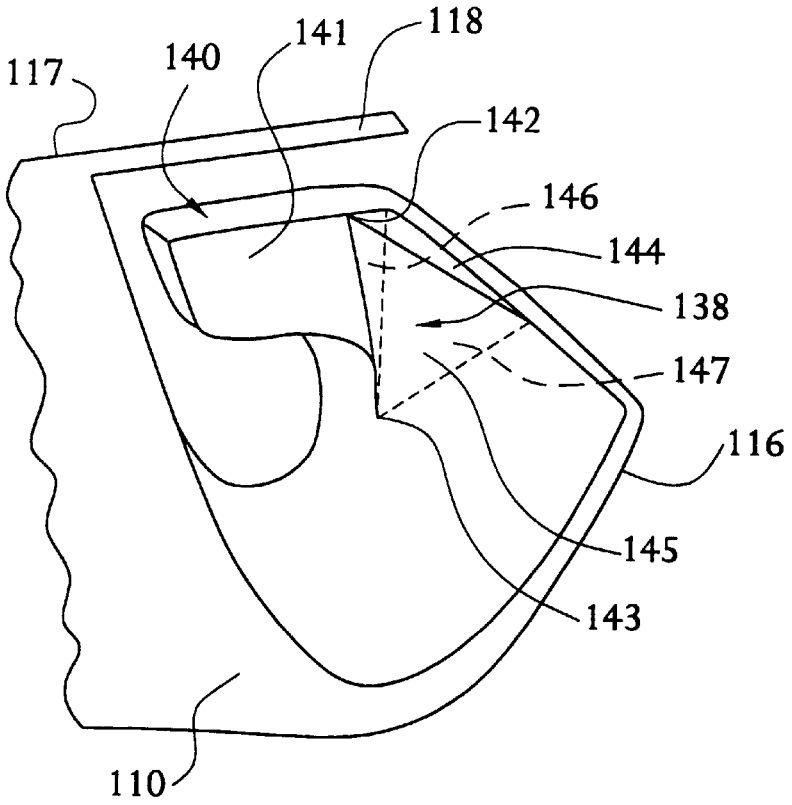
FIG. 12 is an enlarged partial right side perspective view of the inclined wall portion of the latch embodiment of FIGS. 9–11.

In FIG. 12, the cross-sectional thickness of the wall portion 138 decreases from the top edge 142 of the wall portion 138, (at which the wall portion is at its thickest point), to the lower end 143 of the wall portion which, preferably, joins with the thickness of the upstanding wall portion 116.

Preferably, the wall portion 138 can be geometrically described, as a represented in FIG. 12, with a triangular top portion 144, a front portion 145, a side portion 146 which adjoins the side-wall 141 of the protrusion 140, and a rear portion 147. It will be understood that the wall portion 138 can preferably be molded with the latch body 110. It will be noted that the wall portion 138 can comprise a partial helical configuration.

Figure 13:
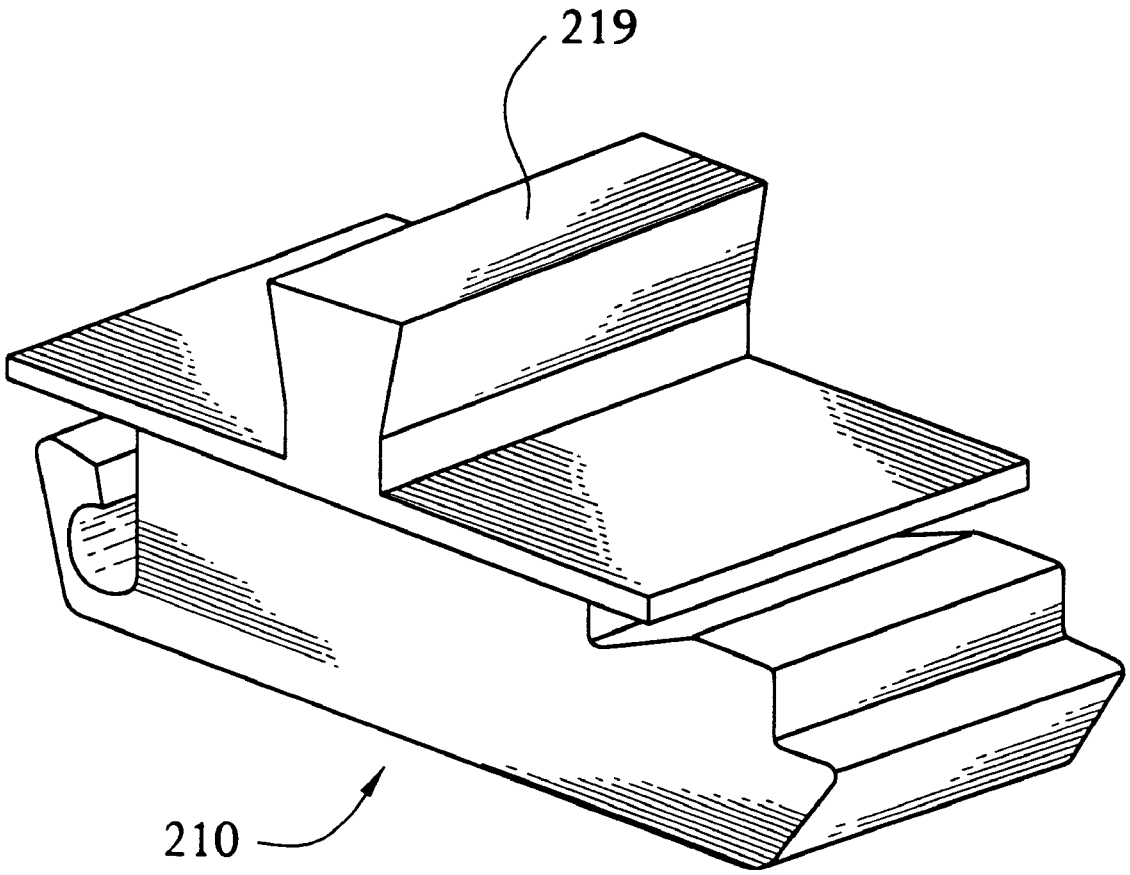
FIG. 13 illustrates a modification in which the hand grip is a thumb-and-finger knob, rather than the finger recess shown in FIGS. 1–4 and in FIGS. 10 and 11.

FIG. 13 illustrates another modification wherein, in lieu of a finger cavity, such as that 19 shown in FIG. 1, the latch 210 is provided with an upper thumb-and-finger projection 219.

The new slam latch which has been described and illustrated has a number of advantages over prior art sliding-action slam-type latches. Its cost of manufacture is low, due to its design as a single component molded of low-cost plastic material. It is fast and simple, and also economical, to install since it requires no fastening devices, no tools, and no fixtures. Once installed, it should operate without mechanical failure since it incorporates no mechanical components which are prone to fail, or to jam, or to malfunction. Installed, it has a neat and attractive appearance. Only the flap top surface of the latch with the finger-grip cavity is visible from the outside of the installation. No unsightly screw heads or other fasteners are present to detract from its appearance and from its style. Also, the plastic material of which the body of the latch is made is not subject to corrosion or to deterioration under normal environmental conditions. Finally, the spring installation means facilitates assembly of the latch.

We claim:

1. A latch of the sliding-action Slam type for installation in an opening in a door panel, said latch comprising:

(a.) a latch body having a shaped recess at its forward end for receiving cooperatively the forward edge of the panel opening;

(b.) said latch body having an upstanding wall portion at its rearward end, the upper end of said wall portion being spaced from a main portion of said latch body and adapted to flex forwardly during snap-in insertion of the latch body into the panel opening and to thereafter snap back into a position to retain the latch body in the panel opening;

(c.) said latch body having also a frame-engaging latching portion at its forward end; and (d.) spring means for biasing said latch body forwardly toward latching position;

(e.) said spring means comprising a metallic spring component carried by said latch body in the space between said upstanding wall portion and the main portion of said latch body, said metallic spring component being shaped to engage the rearward edge of the panel opening, the metallic spring component being partially disposed to extend beyond the upper end of said upstanding wall portion; and (f.) spring installation means for facilitating the installation of the spring member into position within the space between the upstanding wall portion and the main portion of said latch;

(g.) wherein said spring installation means comprises a wall portion having a sloped configuration which includes a transverse slope and a vertical slope for directing the movement of said spring member there along, wherein the spring member is gradually compressed upon insertion.

2. The latch of claim 1, wherein said spring member comprises a torsion spring having a first arm and a second arm which are connected through a coil.

3. The latch of claim 1, wherein said spring member comprises a torsion spring having a first arm and a second arm which are connected through a coil, and wherein said spring installation means comprises leveraging means for engaging said first spring arm and moving said first spring arm upward and away from said upstanding wall portion and toward the main portion of said latch body.

4. The latch of claim 1, wherein compressing said spring member in relation to the compression of said spring member is caused by engagement with the rearward edge of said panel.

5. A method of assembling a latch, the method comprising the steps of:

a) providing a latch having an upstanding wall portion and a body portion, wherein said upstanding wall is spaced from said body portion to define a space therein; said upstanding wall portion having means for leveraging a spring member;

b) providing a torsion spring, member having at least one spring arm extending therefrom;

c) inserting said spring member into the space defined by said upstanding wall and said latch body;

d) wherein the step of inserting the spring member into said space includes moving the spring member along a sloped wall of the means for leveraging the spring member and gradually compressing the spring member as the spring member is inserted;

e) completing the insertion of the spring member and allowing the spring member to remain partially compressed.

6. A method of assembling a latch according to claim 1, the method comprising the steps of:

c) inserting said spring means into the space defined by said upstanding wall portion and said latch body;

d) wherein the steps of inserting the spring member into said space includes moving the spring member along the transverse slope of the spring installation means and gradually compressing the spring means as the spring means is inserted;

e) completing the insertion of the spring means and allowing the spring means to remain partially compressed.

7. A latch of the sliding-action slam type for installation in an opening in a door panel, said latch comprising:

a.) a latch body having, a shaped recess at its forward end for receiving cooperatively the forward edge of the panel opening;

b.) said latch body having an upstanding wall portion at its rearward end, the upper end of said wall portion being spaced from the main portion of said latch body and adapted to flex forwardly during snap-in insertion of the latch body into the panel opening and to thereafter snap back into a position to retain the latch body in the panel opening;

c.) said latch body having also a frame-engaging latching portion at its forward end;

d.) spring means for biasing said latch body forwardly toward latching position;

e.) said spring means comprising a metallic spring member carried by said latch body in the space between said upstanding wall portion and the main portion of said latch body, said metallic spring member being, shaped to engage the rearward edge of the panel opening; wherein said spring member is a torsion spring having a first arm and a second arm which are connected through a coil; and f.) spring installation means for facilitating the installation of the spring member into position within the space between the upstanding wall portion and the main portion of said latch;

g.) wherein said spring installation means further comprises leveraging means for gradually compressing the spring member and leveraging the spring upward relative to said upstanding wall portion.

8. The latch of claim 7, wherein said upstanding wall portion has an interior portion which faces the main portion of said latch body, and wherein said leveraging means comprises a rib protruding from said interior portion of said upstanding wall portion.

9. The latch of claim 8, wherein said rib is inclined.

10. The latch of claim 8, wherein said upstanding wall portion includes a protruding portion extending into the space defined between said upstanding wall and said main portion of the latch body, said protruding portion partially surrounding said spring member, and having at least one sidewall, wherein said rib is inclined from a point along the interior portion of the upstanding sidewall in a direction toward the said at least one sidewall of said upstanding wall protruding portion.

11. The latch of claim 8, wherein said rib extends laterally along the upstanding wall portion from one side thereof toward the center of the latch.

12. The apparatus of claim 11, wherein said rib has a tapered portion at one end thereof.

13. The latch of claim 7, wherein said leveraging means includes an inclined wall portion provided on said upstanding wall portion.

14. The latch of claim 13, wherein said upstanding wall portion includes a protruding portion extending into the space defined between said upstanding wall and said main portion of the latch body, said protruding portion partially surrounding said spring member, and having at least one sidewall, wherein said inclined wall portion is inclined toward the sidewall of said protruding portion.

15. The latch of claim 14, wherein said inclined wall portion has a longitudinal dimension with respect to said upstanding wall portion and is further inclined, the further inclination being in the longitudinal direction, from a lower point along said upstanding wall toward the top of said upstanding wall portion.

16. A latch of the sliding-action slam type for installation in an opening in a door panel, said latch comprising:

a. a latch body having a shaped recess at its forward end for receiving cooperatively the forward edge of the panel opening;

b. said latch body having an upstanding wall portion at its rearward end, the upper end of said wall portion being spaced from the main portion of said latch body and adapted to flex forwardly during snap-in insertion of the latch body into the panel opening and to thereafter snap back into a position to retain the latch body in the panel opening;

c. said latch body having also a frame-engaging latching portion at its forward end; and d. spring means for biasing said latch body forwardly toward latching position;

e. said spring means comprising an additional metallic spring member carried by said latch body in the space between said upstanding wall portion and the main portion of said latch body, said metallic spring member being shaped to engage the rearward edge of the panel opening; and f. spring installation means for facilitating the installation of the spring member into position within the space between the upstanding wall portion and the main portion of said latch;

g. wherein said spring installation means comprises leveraging means;

h. wherein said spring member comprises a torsion spring having a first arm and a second arm which are connected through a series of coils; and i. wherein said leveraging means comprises a sloped wall portion for gradually increasingly compressing the torsion spring during insertion into the latch for installation in the direction of said torsion spring caused by engagement with the rearward edge of said panel.

17. A method of assembling a latch of the sliding-action slam type for installation in an opening in a door panel, the method comprising the steps of:

a. providing a latch having an upstanding wall portion and a body portion, wherein said upstanding wall is spaced from said body portion to define a space therein; said upstanding wall portion having means for leveraging a spring member;

b. providing a torsion spring member having at least one spring arm extending therefrom;

c. inserting said spring member into the space defined by said upstanding, wall and said body portion;

d. wherein the step of inserting the spring member into said space includes moving the spring member along the leveraging means and gradually compressing the spring member as the spring member is inserted;

e. completing the insertion of the spring member and allowing the spring member to remain partially compressed;

f. wherein the leveraging means includes a rib member disposed on the upstanding wall portion, and wherein the step of moving the spring member along the leveraging means includes engaging the at least one spring arm with the rib member.

18. A method of assembling a latch of the sliding-action slam type for installation in an opening in a door panel, the method comprising the steps of:

a. providing a latch having an upstanding wall portion and a body portion, wherein said upstanding wall is spaced from said body portion to define a space therein; said upstanding wall portion having means for leveraging a spring member;

b. providing a torsion spring member having at least one spring arm extending therefrom;

c. inserting said spring member into the space defined by said upstanding wall and said latch body;

d. wherein the step of inserting the spring member into said space includes moving the spring member along the leveraging means and gradually compressing the spring member as the spring member is inserted;

e. completing the insertion of the spring member and allowing the spring member to remain partially compressed;

f. and wherein the step of moving the spring member along the leveraging means includes engaging the at least one spring member arm with a portion of said upstanding wall member which becomes gradually thicker in relation to its original thickness at the side of the latch from which the spring is inserted into the space.

19. A latch of the sliding-action slam type for installation in an opening in a door panel, said latch comprising:

a. a latch body having a shaped recess at its forward end for receiving cooperatively the forward edge of the panel opening;

b. said latch body having an upstanding wall portion at its rearward end, the upper end of said wall portion being spaced from the main portion of said latch body and adapted to flex forwardly during snap-in insertion of the latch body into the panel opening and to thereafter snap back into a position to retain the latch body in the panel opening;

c. said latch body having also a frame-engaging latching portion at its forward end; and d. spring means for biasing said latch body forwardly toward latching position;

e. said spring means comprising a metallic spring component carried by said latch body in the space between said upstanding wall portion and the main portion of said latch body, said metallic spring component being shaped to engage the rearward edge of the panel opening; wherein said spring component is a torsion spring having a first arm and a second arm which are connected through a coil and f. spring installation and leveraging means for facilitating the installation of the spring component into position within the space between the upstanding wall portion and the main portion of said latch and the positioning of said first arm away from said upstanding wall portion and toward the main portion of said latch body.

* * * * *